United States Patent [19]

Bridge

[11] 4,296,704

[45] Oct. 27, 1981

[54] ANTI-GRAVITY SPINNAKER

[76] Inventor: John G. Bridge, P.O. Box 503, Poughkeepsie, N.Y. 12601

[21] Appl. No.: 36,802

[22] Filed: May 7, 1979

[51] Int. Cl.[3] ..... B63H 9/04

[52] U.S. Cl. ..... 114/103; 114/39; 114/111; 244/153 R; 244/33

[58] Field of Search ..... 244/153 R, 31, 33; 114/39, 102, 103, 111

[56] References Cited

U.S. PATENT DOCUMENTS

| | | | |
|---|---|---|---|
| 2,159,923 | 5/1939 | Willard | 114/103 |
| 2,208,786 | 7/1940 | Astle | 244/153 R |
| 2,486,158 | 10/1949 | Haas | 244/33 |
| 3,003,722 | 10/1961 | Pohl | 244/153 R |
| 3,174,453 | 3/1965 | Lemoigne | 114/103 |
| 3,356,059 | 12/1967 | Ross | 114/103 |
| 3,391,668 | 7/1968 | Birchill | 114/103 |
| 3,455,261 | 7/1969 | Perrin | 114/39 |
| 3,720,180 | 3/1973 | Stangeland | 114/102 |
| 3,791,611 | 12/1974 | Babbidge | 244/153 R |
| 3,851,612 | 12/1974 | Jalbert | 114/103 |
| 4,164,193 | 8/1979 | Smith | 114/102 |
| 4,178,867 | 12/1979 | Shyu | 114/39 |

*Primary Examiner*—Trygve M. Blix
*Assistant Examiner*—D. W. Keen
*Attorney, Agent, or Firm*—Brumbaugh, Graves, Donohue & Raymond

[57] ABSTRACT

This invention relates to an improved spinnaker which is lighter-than-air and designed to float ahead of the boat and to retain its shape when subject to wind variations.

8 Claims, 6 Drawing Figures

ANTI-GRAVITY SPINNAKER

BACKGROUND OF THE INVENTION

1. Field of the Invention

This invention relates to an improved spinnaker which is lighter than air and designed to float ahead of the boat and to retain its shape when subject to wind variations.

2. The Prior Art

In sailing a sailboat with the wind behind, it is often desirable to use a spinnaker. Various spinnaker designs have been described in U.S. Pat. Nos. 3,174,453; 3,720,180; 3,356,059 and 3,851,612. A spinnaker is a large light weight sail which is deployed in front of the jib and the mainsail. It helps to capture the wind and propel the boat forward in the water. Although helpful, these large sails present numerous problems to the sailor. A spinnaker is normally attached directly to the mast of the sailboat and requires both a boom and guy. Because of the need for a boom, the size of the spinnaker is usually limited. When the wind dies, a conventional spinnaker is likely to collapse and in doing so, its large size makes it awkward to handle. Because of its large size and light weight it is relatively fragile and if hit by a sudden gust of wind it may rip and shred under the sudden tension. In rough sea a conventional spinnaker often loses the air it has captured and collapses because of the constant rocking of the boat in heavy waves.

The spinnaker described in this application overcomes many of the disadvantages found in using conventional spinnakers.

SUMMARY OF THE INVENTION

In accordance with the invention the novel lighter-than-air spinnaker includes a piece of flexible sail fabric and a plurality of tubular shaped inflatable bags of variable widths attached to the exterior surface of the fabric. The inflatable bags contain a lighter than air gas selected from the group consisting of hydrogen, helium, heated air and mixtures thereof. The bags can be made of elastic plastic film or thin rubber sheeting. The sail fabric can be any conventional material used for making spinnakers. The fabric has a top and a bottom end and at least two sides and an exterior and interior surface. The sail fabric can assume a variety of shapes, two preferred shapes for the spinnaker of this invention being triangular and pentagonal.

In one embodiment of the spinnaker, the inflatable bags are arranged so that the sides of the bags are parallel to the top and bottom ends of the fabric, with the wider bags attached near the top of the fabric and the narrower bags attached near the bottom end of the fabric for proper buoyancy. Preferably the inflatable bags are interconnected so that the pressure throughout all the bags is equalized.

In accordance with an alternate embodiment of the invention, the bags are attached to the sides of the fabric. Again, for proper buoyancy, the narrower bags are attached to the sides near the bottom of the fabric and the wider bags are attached to the sides near the top of the fabric.

In accordance with another alternate embodiment of the invention, the inflatable bags are attached to the exterior surface and the sides of the fabric by flexible connectors. The bags float above the sides and the exterior surface of the fabric and are curved and tapered so that the wider portion of each bag is attached by flexible connectors to the top end of the fabric and the narrower portion of each bag is attached by flexible connectors to the bottom end of the fabric.

The spinnaker is attached to the hull of the boat and the top of the mast by riggings and loops on the fabric. It can either be used alone as the primary spinnaker or in combination with a conventional spinnaker.

The spinnaker of this invention has many advantages. Once it is inflated it will not collapse and will hold its shape even when there is no breeze. Since it is lighter than air the spinnaker does not require a mast, boom or topping lift or forward guy to support it and is therefore easier to handle. In a light breeze it floats high above the mast of the boat where the wind is often stronger and if hit by a sudden gust of wind will absorb the shock more slowly and is less likely to rip apart. Because the spinnaker of this invention floats in the air ahead of the sailboat, it is less likely to react violently to sudden wind changes. Since it is not attached to the mast, it can be larger than conventional spinnakers and still be easily maneuvered.

DETAILED DESCRIPTION OF THE INVENTION

Figure 1:
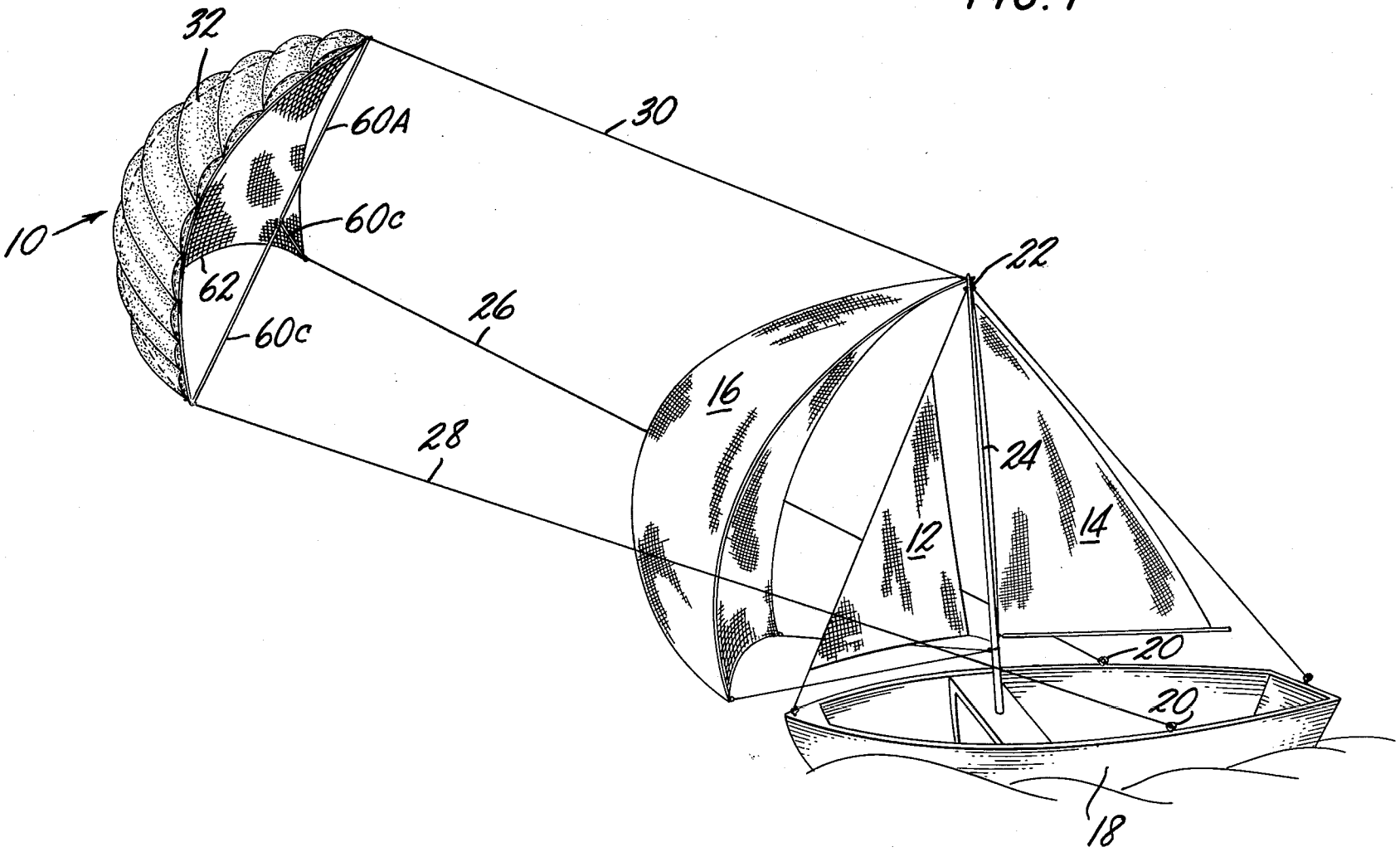
FIG. 1 is a perspective view of the spinnaker of this invention deployed on a sailboat.

As illustrated in FIG. 1 the lighter-than-air spinnaker 10 of the present invention is designed to float ahead of the jib 12, mainsail 14, and if used, the conventional spinnaker 16. The lighter-than-air spinnaker 10 is attached to the hull of the boat 18 at points 20 on the edge of the hull and to the top 22 of the mast 24 by starboard rigging 26, port rigging 28 and top rigging 30, respectively. The lighter-than-air spinnaker 10 is held aloft by inflatable bags, indicated schematically at 32 in FIG. 1, attached to the exterior surface of the spinnaker.

Figure 2:
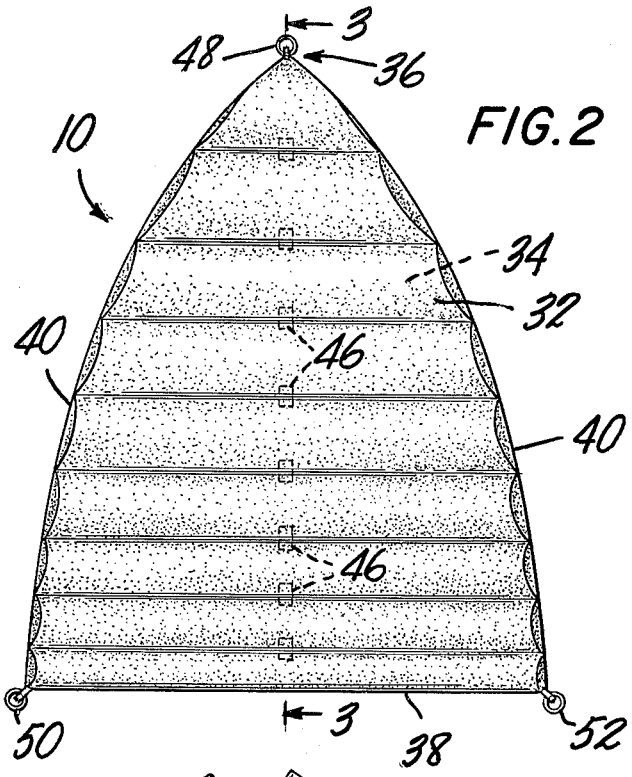
FIG. 2 is a front view of an embodiment of the spinnaker of this invention.
Figure 3:
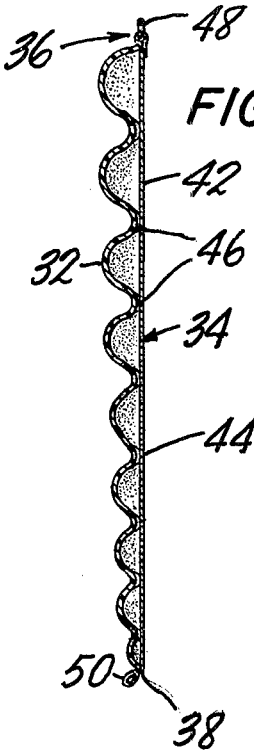
FIG. 3 is a vertical cross-sectional view of the spinnaker of FIG. 2 along line 3—3.

One embodiment of the lighter-than-air spinnaker of the present invention is illustrated in FIGS. 2 and 3. The triangular shaped spinnaker includes a piece of flexible sail fabric 34 having a top end 36 a bottom end 38, two sides 40, and exterior and interior surfaces 42 and 44, respectively. In the embodiment of FIGS. 2 and 3, the inflatable bags 32 are generally tubular in construction and are attached to the exterior surface 42 so that the sides of the bags are parallel to the top end 36 and the bottom end 38 of the sail fabric 34. Preferably, the bags attached near the top end of the fabric are wider than those attached near the bottom end of the fabric. This gives greater buoyancy to the upper part of the sail and tends to maintain the sail in an upright (top up) position. The bags 32 may contain any suitable lighter-than-air gas, such as hydrogen, helium, heated air or mixtures thereof. The interiors of the bags 32 are preferably interconnected by connecting tubes 46 or the like for the purpose of equalizing the pressure in all of the bags.

Loops 48, 50, 52 are provided for attachment of the sail to the top rigging 30, port rigging 28 and starboard rigging 26, respectively.

Figure 4:
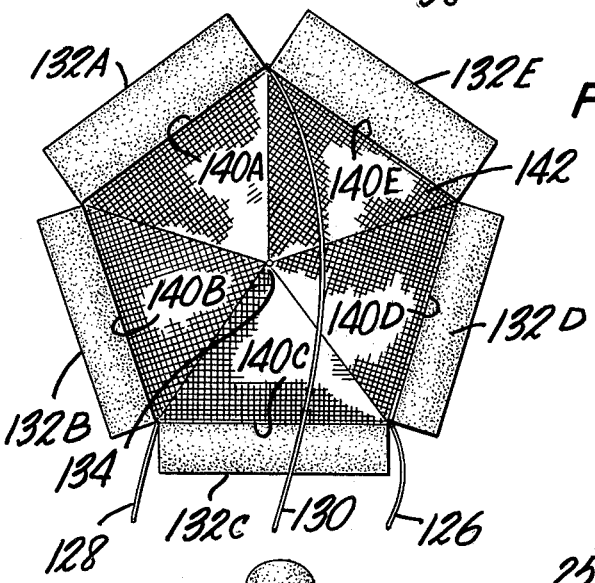
FIG. 4 is a rear view of an alternate embodiment of the spinnaker of this invention.
Figure 5:
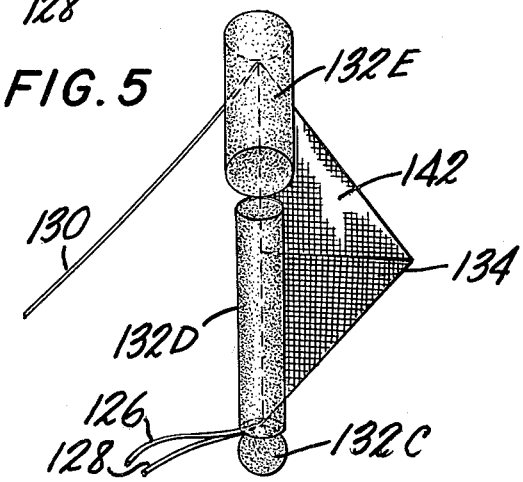
FIG. 5 is a side view of the spinnaker in FIG. 4.

In an alternate embodiment of the lighter-than-air spinnaker shown in FIGS. 4 and 5, tubular inflatable bags 132A, 132B, 132C, 132D and 132E are attached to the five sides 140A, 140B, 140C, 140D, 140E, respectively, of pentagonal sail fabric 134. As in the prior embodiment, the bags 132B, 132C and 132D attached to the sides near the bottom of the fabric 134 are preferably narrower than the bags 132A and 132B attached to the sides near the top of the fabric, for the purpose of holdiong the sail in an upright position. The pentagonal shape allows the exterior surface 142 of the sail to balloon out ahead of the bags, as shown in FIG. 5. The pentagonal spinnaker is attached to the boat by top rigging 130, port rigging 128 and starboard rigging 126.

Figure 6:
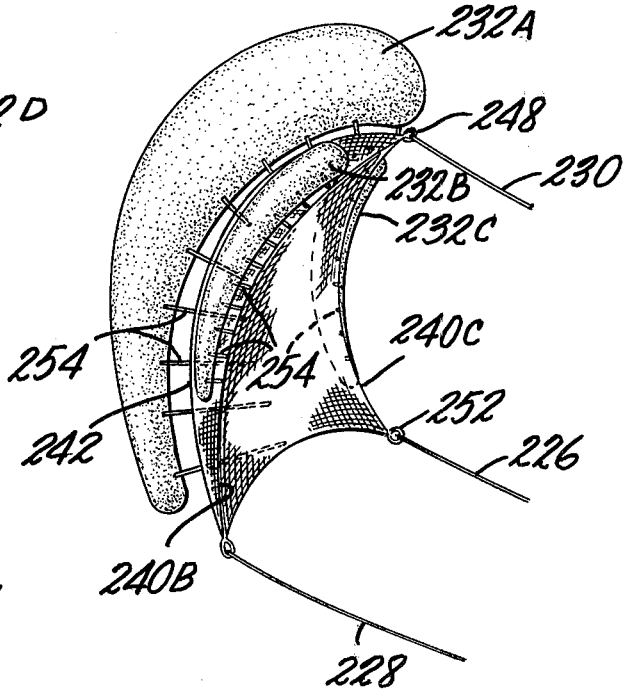
FIG. 6 is a perspective view of still another embodiment of the spinnaker of this invention.

In another embodiment of the invention illustrated in FIG. 6 a central, large inflatable bag 232A is attached to the middle of the exterior surface 242 of the sail fabric and two smaller bags 232B and 232C are attached along the sides 240B and 240C of the fabric. Suitably the bags are attached by a plurality of flexible connectors 254 which allow the bags to float above the middle and sides of the sails as the case may be. The sail is attached by loops 248, 250 and 252 to the boat by a top rigging 230, a port rigging 228 and a starboard riggint 226. The bags 232A, 232B and 232C are generally of the same configuration, i.e., narrow at the bottom and tapering outwardly to a wider upper part, and preferably are curved in cross section to conform generally to the curvature of the sail when the sail is filled.

For added stability, the corners of the spinnaker may be linked by lines 60A, 60B and 60C in the manner shown in FIG. 1. This aids in keeping the sail from turning inside out. Also, a piece of curved light plastic material 62 (see FIG. 1) may be fastened along the interior side of the lower edge of the sail in order to give the sail an efficient posture in light or negligible winds. Such a strip also aids in minimizing sail distortion in heavy gusts.

While the invention has been particularly shown and described with reference to several preferred embodiments, it will be understood by those skilled in the art that various changes in form and detail may be made thereon without departing from the spirit and scope of the invention. For example, although the sail fabric is shown as being triangular or pentagonal, other geometric shapes may be used. If desired, the exterior surface of the inflatable bags may be formed of a transparent or translucent material to facilitate the passage of solar heat to the interior of the bag, thereby heating the gas within the bag and enhancing the buoyancy of the sail. This is particularly useful where the lighter-than-air gas is hot air. As a further refinement in this regard, the bags may be constructed of a heat absorbing material or, alternatively, a dark or black heat absorbing layer may be provided within a translucent or transparent bag, such as on the exterior surface of the sail fabric for example, to enhance heating of the gas within the bag. All such modifications and variations, therefore, are intended to be included within the spirit and scope of the appended claims.

I claim:

1. A spinnaker large enough to aid a sailboat when sailing with the wind behind the boat, comprising:

a piece of flexible sail fabric having a top end, a bottom end and at least two sides, an interior surface and an exterior surface;

a plurality of tubular shaped inflatable bags of variable widths attached to the exterior surface of the fabric and containing a lighter-than-air gas;

stabilizing lines extending from the corners of the interior surface of the fabric said lines joined above the surface of the fabric at about the mid-point of the interior surface; and means at three pointss on the spinnaker for attaching riggings from the spinnaker to both sides of the hull of the boat and to the top of the mast.

2. The spinnaker of claim 1 wherein the inflatable bags are attached to the exterior surface of the fabric so that the sides of the bags are generally parallel to the top end and the bottom end of the fabric, at least one of the bags attached near the top end of the piece of fabric being wider than the bags attached near the bottom end of the piece of fabric.

3. The spinnaker of claim 2 wherein the interiors of the inflatable bags are interconnected so as to equalize the pressure within the bags.

4. The spinnaker of claim 1 wherein the inflatable bags are attached to the sides of the fabric, the bags attached to the sides near the bottom of the fabric being narrower than the bags attached to the sides near the top of the fabric.

5. The spinnaker of claim 1 wherein the lighter-than-air gas is selected from the group consisting of hydrogen, helium or heated air and mixtures thereof.

6. The spinnaker of claim 1 wherein the inflatable bags are attached to the exterior surface and to the sides of the fabric by a plurality of flexible connectors which allow the bags to float above the sides and the exterior surface of the fabric.

7. The spinnaker of claim 6 wherein the bags are curved and tapered in cross section such that the wider portion of the bag is attached to the top end of the fabric and the narrower portion of the bag is attached to the bottom end of the fabric and the bag conforms generally to the curvature of the fabric when the sail is filled.

8. The spinnaker of claim 1 wherein the inflatable bags are constructed from a heat absorbing material.

* * * * *